US008711658B2

(12) United States Patent
Goeller

(10) Patent No.: US 8,711,658 B2
(45) Date of Patent: Apr. 29, 2014

(54) INSTANTANEOUS SINGLE CLICK PERPETUAL DATE MECHANISM

(75) Inventor: Eric Goeller, Les Hôpitaux Vieux (FR)

(73) Assignee: Montres Breguet S.A., L'Abbaye (CH)

( * ) Notice: Subject to any disclaimer, the term of this patent is extended or adjusted under 35 U.S.C. 154(b) by 119 days.

(21) Appl. No.: 13/424,532

(22) Filed: Mar. 20, 2012

(65) Prior Publication Data

US 2012/0243382 A1 Sep. 27, 2012

(30) Foreign Application Priority Data

Mar. 22, 2011 (EP) ..... 11159239

(51) Int. Cl.
*G04B 19/24* (2006.01)

(52) U.S. Cl.
USPC ..... 368/28; 368/37

(58) Field of Classification Search
USPC ..... 368/34–36, 37–38, 28
See application file for complete search history.

(56) References Cited

U.S. PATENT DOCUMENTS

| | | | | |
|---|---|---|---|---|
| 563,268 | A | 7/1896 | Fazel | |
| 4,674,889 | A * | 6/1987 | Klaus | 368/28 |
| 6,295,250 | B1 * | 9/2001 | Ray et al. | 368/37 |
| 6,912,180 | B2 * | 6/2005 | Dias | 368/37 |
| 7,038,974 | B2 * | 5/2006 | Dalloz | 368/28 |
| 7,139,224 | B2 * | 11/2006 | Schneider | 368/28 |
| 7,480,211 | B2 * | 1/2009 | Golay | 368/28 |
| 2006/0215497 | A1 | 9/2006 | Schneider | |
| 2007/0189122 | A1 | 8/2007 | Golay | |

FOREIGN PATENT DOCUMENTS

| | | | |
|---|---|---|---|
| CH | 660 440 G | A3 | 4/1987 |
| CH | 698 310 | B1 | 7/2009 |
| EP | 1 818 738 | A2 | 8/2007 |
| WO | WO 2009/004423 | A2 | 1/2009 |

OTHER PUBLICATIONS epo.org—Machine Translation for CH 660440 A3 :: Sep. 6, 2013.*
European Search Report issued Oct. 11, 2011, in Patent Application No. EP 11159239.0 filed Mar. 22, 2011 (With English-language Translation).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

Date mechanism for a timepiece including a movement which daily pivots a lever, comprising a perpetual twelve cam with sectors whose depth depends on the duration of the successive months, completing one revolution per year. The mechanism has a single click and includes a single click finger, hinged to said lever and arranged to cooperate with a thirty-one ratchet wheel which pivots integrally with a first thirty-one snail cam arranged to control a date display means, and a second cam including a radial finger; a countdown mechanism whose position is determined by said second cam, adjusting the number of teeth of said wheel to be activated by said click finger according to the current day and current month; and a means of driving said cam.

11 Claims, 13 Drawing Sheets

Fig. 16
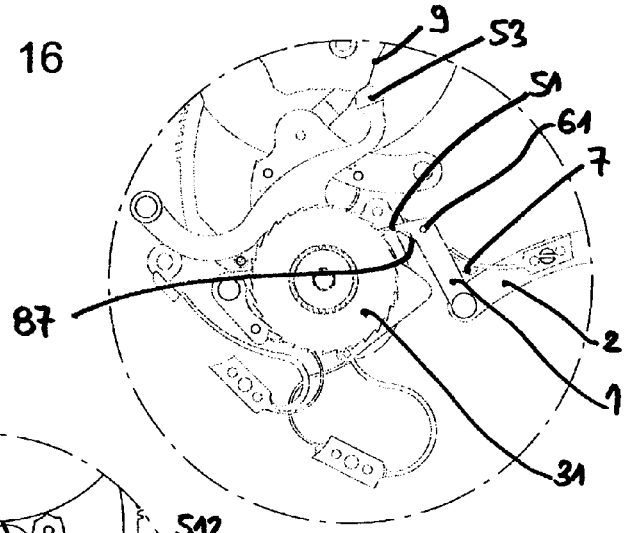
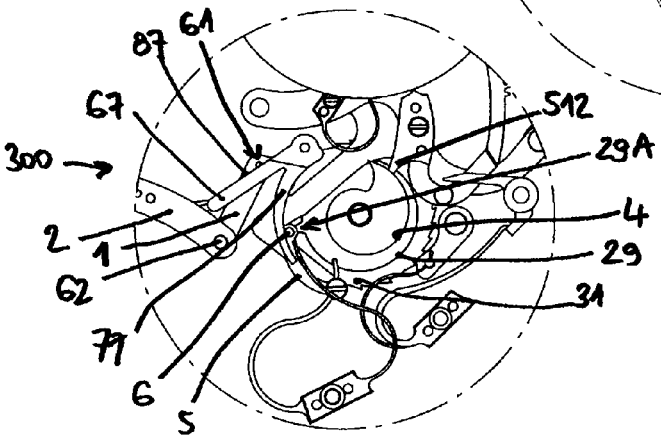
Fig. 17
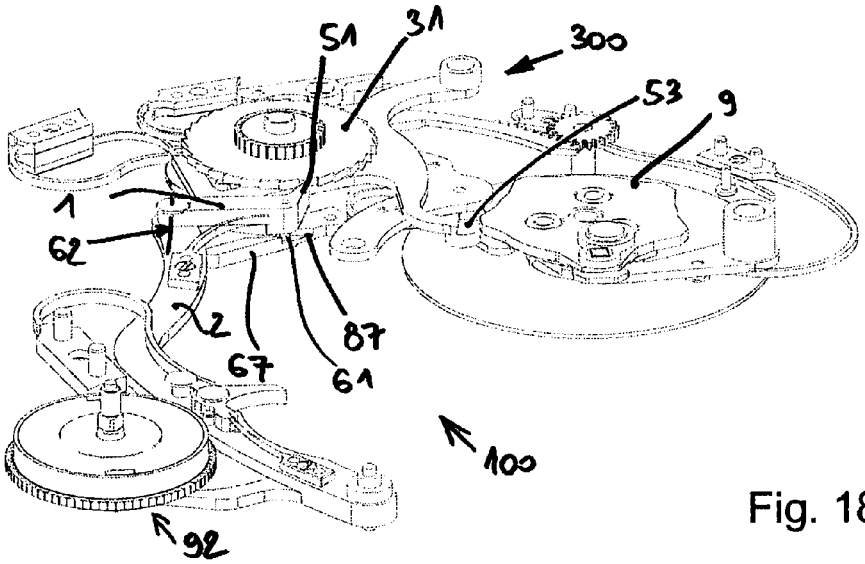
Fig. 18

Fig. 22
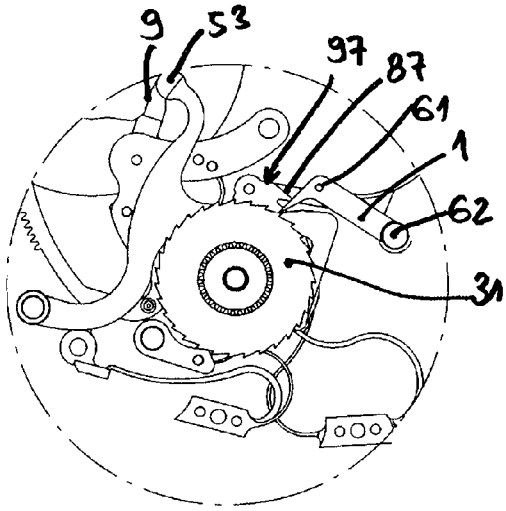
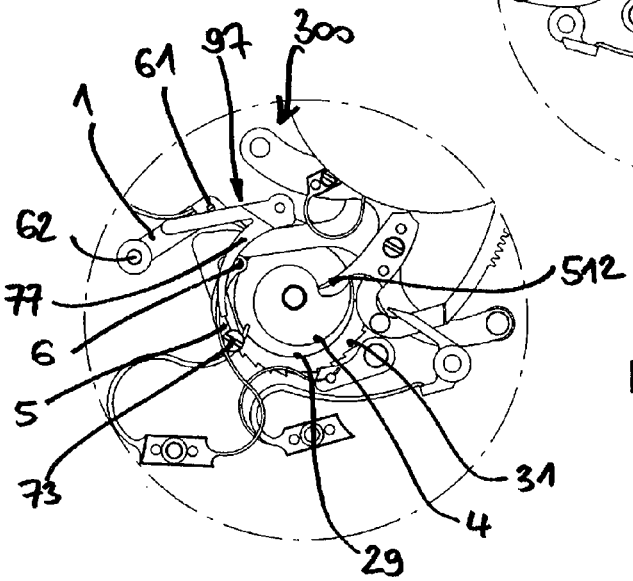
Fig. 23
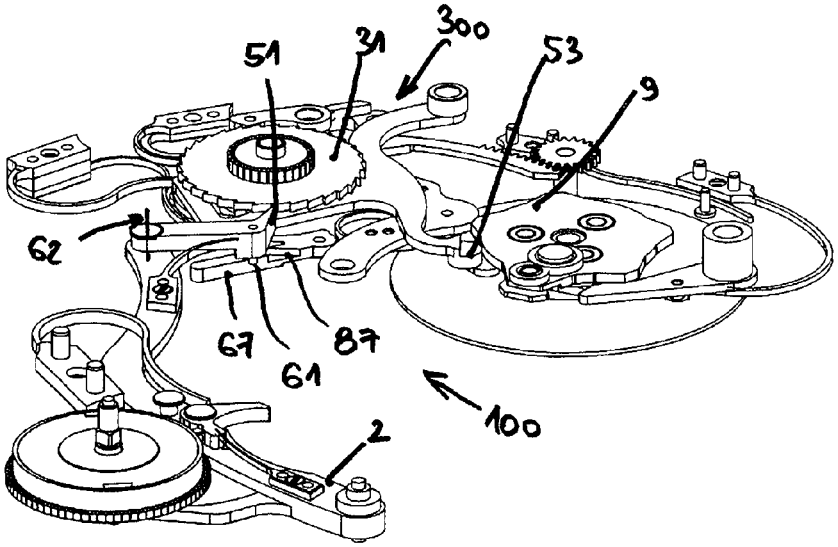
Fig. 24

INSTANTANEOUS SINGLE CLICK PERPETUAL DATE MECHANISM

This application claims priority from European Patent Application No. 11159239.0 filed Mar. 22, 2011, the entire disclosure of which is incorporated herein by reference.

FIELD OF THE INVENTION

The invention concerns a date mechanism for a timepiece, which includes a movement arranged to actuate, once a day, a pivoting movement of a perpetual lever, comprised in said date mechanism, said mechanism including a means of driving a perpetual twelve cam, which includes twelve sectors for the successive months of different radial dimensions depending upon the duration of each month, and which completes one revolution per year.

The invention also concerns a timepiece including a movement and including a date mechanism of this type.

The invention concerns the field of horology, and more specifically the field of timepieces including date mechanisms.

BACKGROUND OF THE INVENTION

The most conventional date timepieces are described in particular in the work entitled "Les montres compliquées" (Complicated Watches) by Franøois Lecoultre and edited by Editions Horlogères in Bienne.

In an instantaneous date mechanism, star wheels for the days of the week, the month of the year and the date are all activated by the same perpetual lever, which is pivotally mounted relative to the plate or to a bridge of the timepiece movement, and which accomplishes its date change function when the day changes, in an abrupt movement, at a precise moment, by the action of a beak and two clicks, comprised in said perpetual lever. This jump is performed around midnight.

This perpetual lever is returned by a spring to a rest position where one of the beaks thereof abuts on a first sector of a month cam, carried by a month star wheel with 12 teeth which completes one revolution per year. The radius of this month cam is representative of the number of days in the month concerned, either in the form of a notch of greater or lesser depth, or in the form of a projecting portion of greater or lesser extension.

This perpetual lever is abruptly pivoted by a wheel, which is connected to the movement and completes one revolution in 24 hours, said wheel carrying a drive pin for a heart piece against a roller mounted on a pivoting part returned by a spring. When the heart piece passes a point, this starts the abrupt movement of an index which drives a beak of the perpetual lever.

During its pivoting movement, the perpetual lever moves away from said month cam, in order to return to abut on the month cam at the end of its movement, or to the same position, if it occurs during the month, or to abut on the sector next to the first sector of said month cam, if said cam has pivoted when actuated on the occasion of a change of date.

Another beak of the perpetual lever controls the pivoting of a day of the week star wheel. Since the sequence of days is perpetual, no particular mechanism is required, since it is sufficient to increment the position of this star wheel by one step.

The pivoting of a thirty-one star wheel with thirty-one teeth is achieved via a first thirty-one click, which is pivotally mounted on the perpetual lever and whose pivoting is limited by a pin fixed to said lever. This thirty-one star wheel pivots integrally with a first cam and a second cam both of which are snails.

The first snail cam is arranged to cooperate with a first feeler spindle comprised in a pivoting month lever, returned towards said first cam by a spring. The function of this first cam is to cause the month lever to fall at the appropriate time. The month lever includes for this purpose, opposite the first feeler spindle, a second feeler spindle arranged to cooperate with the month star wheel with 12 teeth, and to push said month star by one tooth when the first feeler spindle falls from the large radius to the small radius of the snail.

The second snail cam includes a simple catch, against which a second click acts, called the end of month make up click, carried by the perpetual lever, and which abuts thereon via a spring, and this second click only has an effect for months which do not have 31 days.

At the end of a February with 28 days, the beak of the perpetual lever is in the deepest notch of the month cam, and, during the change from the 27th to the 28th of the month, the second click is engaged in the catch of the second snail cam. This particular adjustment of the perpetual lever allows the second click to drive four teeth of the thirty-one star wheel together, when the perpetual lever jumps around midnight on the 28th of the month. Simultaneously, the first snail cam actuates the pivoting of the month lever, which drives the month star wheel, and thus the month cam, to pass to the sector for the next month, which in this case is March. Consequently, the perpetual lever takes a new rest position during the month of March, which is such that the fall of the second click is delayed by four days. Thus, from the 28th March to the 1st April, this second click only drives one tooth of the thirty-one star wheel at a time.

Likewise, the notch of the month cam for the months of 30 days is arranged so that the second click drives two teeth of the thirty-one star wheel on the evening of the 30th of the month.

Likewise, the notch of the month cam for the months of February with 29 days in leap years is arranged so that the second click drives three teeth of the thirty-one star wheel on the evening of the 29th of the month.

This tried and tested system requires two clicks to ensure the proper operation of the instantaneous perpetual date mechanism. It is difficult to adjust the hands. This arrangement is vulnerable to any disturbance, connected to a shock or improper operation, and must be returned to the workshop if the positions of the parts are lost.

CH Patent Application No. 660 440 A3 in the name of DUBOIS & DEPRAZ SA discloses a perpetual date mechanism which includes a large lever which is pushed by the movement and includes five fingers and a click. This click abuts on the periphery of a snail cam fixed to a thirty-one day wheel. Said wheel carries an actuating finger able to cooperate with a forty-eight month wheel. A first finger, formed by one end of the lever, is located on the path of an actuating finger, which can be driven by a pin carried by the twenty-four hour wheel. This actuating finger carries a convex dorsal part forming a cam, which actuates said perpetual date mechanism. In leap years, a second finger enters into contact with a lever comprised in a leap year cam. A third finger cooperates with a twelve month cam. A fourth finger forming a drive beak cooperates with the toothing of a thirty-one day wheel carrying the snail cam, said fourth finger works every day, whereas the click carried by the lever only works at the ends of the months. A fifth finger forming a second drive beak cooperates with a seven day star wheel. Due to this construction, disruptions are different depending on whether they occur for days with one jump (from 1st to 27th) or days with several jumps (28th to 31st).

Consequently the torque is used irregularly and the behaviour of the mechanism differs according to the duration of the current month.

SUMMARY OF THE INVENTION

The invention proposes to avoid the use of these two clicks. Indeed, this type of perpetual lever with two clicks and their springs has significant inertia, which is not favourable for precise stopping. The adjustment of these two clicks relative to each other is, moreover, quite delicate, and sensitive to shocks and any improper operations that the timepiece may undergo, in particular when the user operates the timepiece around midnight.

This problem of inertia is particularly marked in the case of a retrograde date mechanism, where problems of rebound, which are already difficult to limit, are amplified in the event of significant inertia.

The invention also proposes to develop a date mechanism which is easier to arrange in a timepiece than known mechanisms, and in particular so that this mechanism can be arranged in a peripheral area of the watch, less congested by the complications.

The invention therefore concerns a date mechanism for a timepiece, which includes a movement arranged to actuate, once per day, the pivoting movement of a perpetual lever comprised in said date mechanism, said mechanism comprising a means of driving a perpetual twelve cam, which includes twelve sectors for the successive months, of different radial size according to the duration of each month, and which completes one revolution per year, characterized in that said mechanism has a single click and includes a single click finger, hinged to said perpetual lever and arranged to cooperate directly with a toothing comprised in a thirty-one ratchet wheel which pivots integrally about a pivot axis of a first thirty-one snail cam directly or indirectly controlling a date display means, and a second cam determining the position of a countdown mechanism arranged to adjust the duration of cooperation between said click finger and said wheel according to the current month and the current day of the month and to determine each day the number of teeth of said wheel to be actuated, and said countdown mechanism measuring the duration of the current month on said perpetual twelve cam and according to the position of a pin comprised therein, allowing, limiting or preventing cooperation between a beak of said click finger and said thirty-one ratchet wheel.

According to one feature of the invention, said countdown mechanism includes a first isolator which is pivotally mounted about a pivot, and includes a feeler spindle finger for measuring the duration of the current month on said perpetual twelve cam, and which also carries, hinged to one arm thereof on a pivot, a loose mounted lever, which pivots substantially tangentially to said second cam and which includes, at a distance from said pivot, a pin arranged to cooperate with said second cam on the side of said pivot axis of said thirty-one wheel, and, on the side opposite said axis, with a first arm of a second isolator pivotally mounted on a pivot comprised in a plate or a bridge of said movement, or said timepiece or said mechanism, said second isolator including a second arm arranged, according to the position thereof, to allow, limit or prevent the cooperation of said beak of said click finger with said wheel.

According to another feature of the invention, said second arm of said second isolator includes a cut-out arranged to allow said pin to escape from said click finger to uncouple said beak from said wheel.

According to another feature of the invention, said second arm of said second isolator includes an external bearing surface on the opposite side to said pivot axis, arranged to form a bearing surface for said pin.

According to another feature of the invention, said first arm of said second isolator is arranged to form a stop member for said pin.

According to yet another feature of the invention, said date mechanism includes a control lever pivotally mounted on a pivot comprised in a plate or a bridge of said movement or of said timepiece or said mechanism, said control lever including a feeler spindle arranged to follow said first cam, which pivots said control lever to drive said date display means via a drive element, and said control lever further includes, pivotally mounted on a click pivot, a hook arranged to ensure the driving of said perpetual twelve cam at the end of each month.

According to yet another feature of the invention, said date mechanism is an instantaneous date mechanism via an abrupt daily action, at midnight, of an instantaneous mechanism arranged to pivot said perpetual lever instantaneously.

According to yet another feature of the invention, said instantaneous mechanism includes a barrel, which carries a plurality of pins, each arranged to interact with a feeler spindle finger comprised in said perpetual lever, to pivot said lever instantaneously.

The invention further concerns a timepiece comprising a movement, and including a date mechanism of this type, characterized in that said movement is arranged to actuate, once per day, a pivoting movement of a perpetual lever comprised in said date mechanism.

The mechanism works when the lever falls and not when it rises. This operation as the lever falls allows an instantaneous operation: the lever rises slowly, especially when there are several days to pass, and operates instantaneously during the return by the action of a spring. A single click drives the number of teeth necessary to adjust the date. The lever does not directly make the day jumps, but winds a spring which performs said jumps, thus the invention regularises the level of torque used by the mechanism.

BRIEF DESCRIPTION OF THE DRAWINGS

Other features and advantages of the invention will appear upon reading the following detailed description, with reference to the annexed drawings, in which:

FIGS. 10 to 27 show steps in the kinematics of the date mechanism according to the invention, selected at particular dates illustrating the operation of the countdown mechanism.

FIGS. 10, 11, 12 are respectively bottom, top and perspective top views of the mechanism in the rest position on 30th November.

FIGS. 13, 14, 15, are respectively bottom, top and perspective top views of the mechanism in action, prior to the passage of the finger into the cut-out of the second isolator, on 30th November.

FIGS. 16, 17, 18 are respectively bottom, top and perspective top views of the mechanism in action, when the finger passes into the cut-out of the second isolator, on 30th November.

FIGS. 19, 20, 21 are respectively bottom, top and perspective top views of the mechanism in action, when the finger passes into the cut-out of the second isolator, on 31st December.

FIGS. 22, 23, 24 are respectively bottom, top and perspective top views of the mechanism in action, wound to a maximum, on 1st December.

FIGS. 25, 26, 27 are respectively bottom, top and perspective top views of the mechanism in action, when the date changes from 1st to 2nd December, during which the finger cannot pass through the cut-out.

DETAILED DESCRIPTION OF PREFERRED EMBODIMENTS

Figure 1:
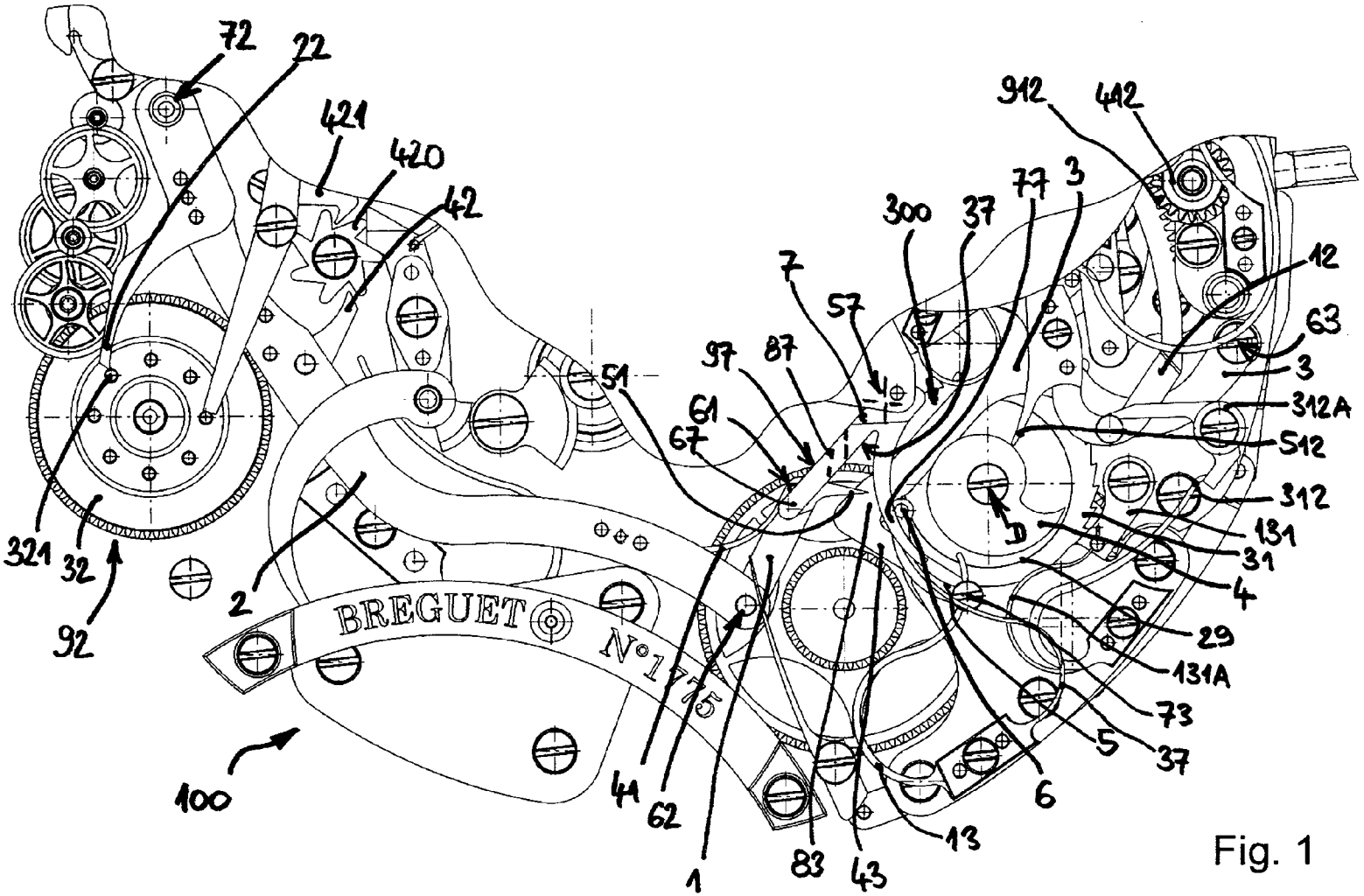
FIG. 1 shows a schematic, partial and plan view of a first side, called the top side, of a timepiece formed by a watch, comprising a date mechanism according to the invention, and showing the kinematics between a mechanism for the instantaneous actuation of the daily pivoting of a perpetual lever, a countdown mechanism and a date display means.
Figure 2:
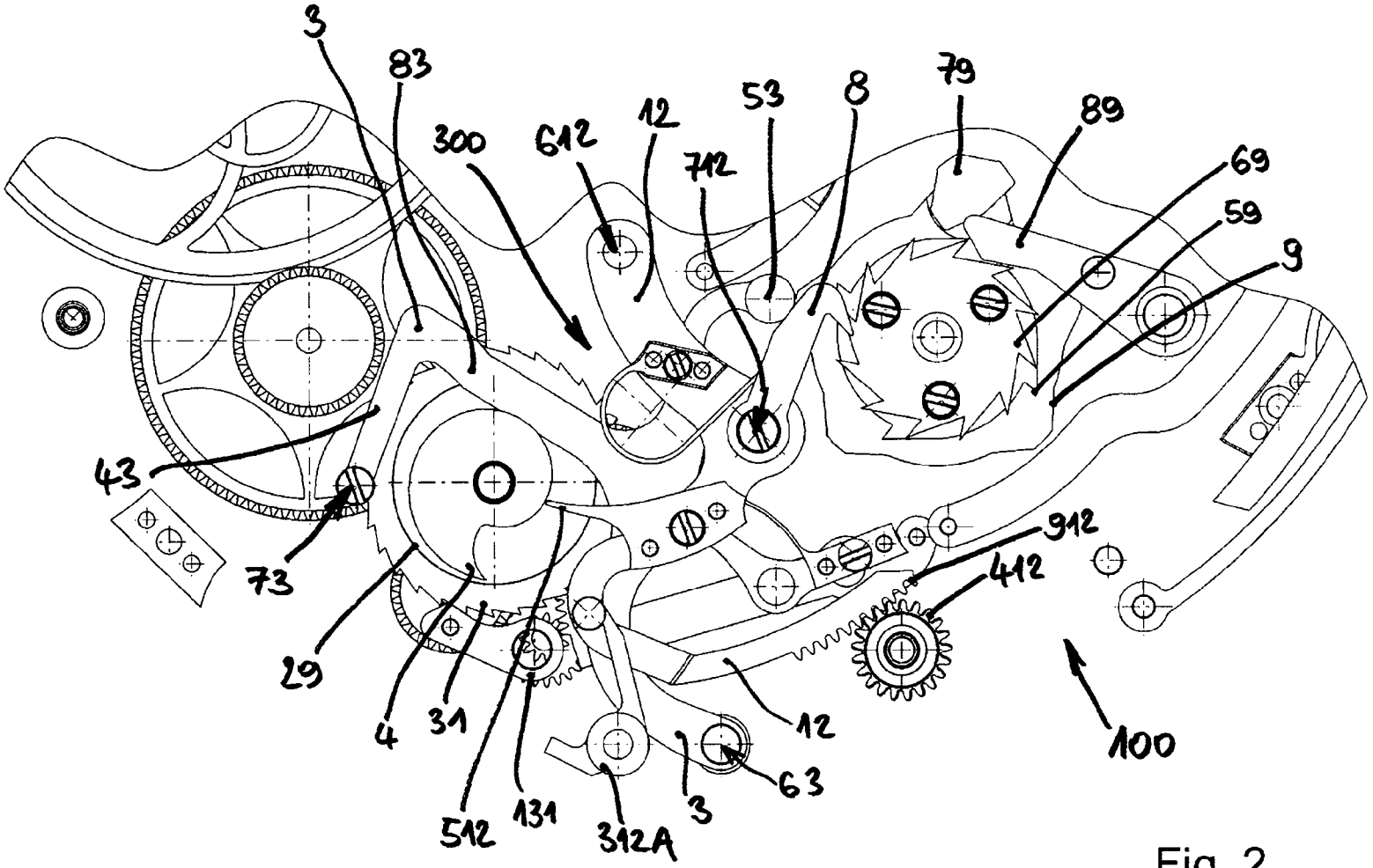
FIG. 2 shows, similarly to FIG. 1, a detailed partial view of the top side, of the same timepiece.

The invention presents a date mechanism which is easier to arrange in a timepiece than known mechanisms, and in particular so that this mechanism can be arranged in a peripheral area of the watch, less congested by the complications.

The invention is described here for the particular case of an instantaneous retrograde date mechanism, but it can be applied to any instantaneous date mechanism.

The invention concerns a date mechanism 100 for a timepiece 1000, which includes a movement 200.

This date mechanism 100 includes various isolators and levers, of which the form shown here is only illustrative, and which is essentially imposed by the other complications comprised in the timepiece, and by the necessity of avoiding interference, which may result in more complex forms than required by the actual functions.

Likewise, it should be understood that the invention can be adapted to any desired periodicity. Those skilled in the art know how to transpose the daily periodicity set out in detail here to other time periods. Likewise, the invention may be used for particular calendars, to replace the control members described herein which have 12 months per year of 28 to 31 days, with other control members with a different number of periods, and amplitudes of different duration.

Movement 200 is arranged to actuate, once per day, a pivoting movement of a perpetual lever 2, comprised in the date mechanism 100.

This mechanism 100 includes a means of driving a perpetual twelve cam 9, which includes twelve sectors for the successive months, of different radial size according to the duration of each month, and which completes one revolution per year.

In a preferred embodiment, as shown in the Figures, it includes a mechanism for adjusting the duration of the month of February for normal or leap years, or, in another variant, additionally, for common end of century years.

According to the invention, mechanism 100 has a single click and includes a single click finger 1, hinged to perpetual lever 2 and arranged to cooperate directly with a toothing of a thirty-one ratchet wheel 31 which pivots integrally about a pivot axis D, of a first date cam, and a second cam 29 determining the position of a countdown mechanism 300. The countdown mechanism is arranged to adjust the duration of cooperation between click finger 1 and the thirty-one ratchet wheel 31 according to the current month and the current day of the month and to determine each day the number of teeth of the thirty-one ratchet wheel 31 to be actuated. This countdown mechanism 300 measures the duration of the current month on the perpetual twelve cam 9 and, according to the position of a pin 6 comprised therein, allows, limits or prevents the cooperation of a beak 51, comprised in click finger 1, with the thirty-one ratchet wheel 31.

The single click finger 1 is hinged on a pivot 62 at one end of the perpetual lever 2 and is arranged to cooperate with a toothing comprised in the thirty-one ratchet wheel 31, pivoting integrally about a pivot axis D of a first thirty-one snail cam 4, and a second cam 29 comprising a radial finger 29A. Preferably, the click finger 1 is bent between pivot 62 on the one hand, and beak 51 on the other hand.

This first cam 4 is arranged to directly or indirectly control a date display means 412.

Mechanism 100 further includes, for determining each day the number of teeth of wheel 31 to actuate, a countdown mechanism 300 whose position is determined by that of the second cam 29 and which is arranged to adjust the duration of cooperation between click finger 1 and wheel 31 according to the current month and the current day of the month.

According to the invention, mechanism 100 is an instantaneous date mechanism via an abrupt daily action, at midnight, of an instantaneous mechanism 92 arranged to pivot the perpetual lever 2 instantaneously.

Thus, this date mechanism 100 includes a perpetual lever 2, which is pivoted on an axis 72 relative to the plate or to a bridge of timepiece 1000, and which is pivoted abruptly once per day by movement 200.

In a conventional manner, not shown in the Figures, this perpetual lever 2 can cooperate with a finger of a 24 hour wheel, which pivots the lever once per day, one of the arms thereof then actuating a 7 star wheel positioned by a jumper spring, for the display of the day of the week.

However, preferably, according to the invention, the instantaneous mechanism 92 includes a barrel 32 which carries a plurality of pins 321, each arranged to interact with a feeler spindle finger 22 comprised in the perpetual lever 2, to pivot said lever instantaneously.

Thus, perpetual lever 2 pivots each day at midnight, by the action of an instantaneous mechanism 92 with a barrel 32, which carries pins 321, which interact with a feeler spindle finger 22 of the perpetual lever 2, to pivot said lever instantaneously. Thus, the invention frees the period from 22.00 hours to 24.00 hours which is usually devoted to the change of date in date timepieces, and during which performing other operations is not recommended or is prohibited.

Click finger 1 alone fulfils the function of activating the perpetual date mechanism, in cooperation with wheel 31.

This click finger 1 is arranged to cooperate, during the daily pivoting of perpetual lever 2, with a so called thirty-one ratchet wheel 31 which is in continuous, non retrograde rotation and which is connected, pivotally integral about a pivot axis D, to a first snail cam 4 called a thirty-one cam, and to a second cam 29 which includes, projecting beyond a first radius R3, a radial finger 29A called a thirty-one finger 29A having a second radius R4 greater than R3. Click finger 1 is returned towards pivot axis D by a spring 41.

According to the invention, this thirty-one wheel is in continuous, non-retrograde rotation, which explains why the invention can be used for a retrograde or non-retrograde date mechanism. For a retrograde display, as illustrated in the Figures, this function is performed downstream of the thirty-one wheel.

Each day, click finger 1 pivots wheel 31 by one step via beak 51, until the 28 th of the month. At the end of the month, the correction is variable depending upon the current month displayed, and click finger 1 drives more or fewer teeth of wheel 31. This click finger 1 is bent between pivot 62 and beak 51 thereof, and includes a projecting pin 61, located substantially in the bend.

The second arm 67 of said second isolator 7 includes a cut-out 87 arranged, in certain positions relative to said second isolator 7 and said click finger 1, to allow said pin 61 to escape from said click finger 1 to uncouple said beak 51 from said wheel 31.

When perpetual lever 2 is not driven by the finger of the 24 hour wheel, it is returned by a spring to a rest position.

A perpetual twelve cam is driven by the date mechanism 100 itself, as will be explained hereinafter, and completes one revolution per year.

This cam 9 is coaxial to a wheel 59 with four teeth, and a ratchet wheel 69 with twelve teeth. Cam 9 carries a leap year cam 79, such as a Maltese cross or similar, the pivoting of which is controlled by wheel 59 with four teeth. The assembly formed by cam 9 and wheel 59 carries or drives a month display indicator.

According to the invention, the countdown mechanism 300 includes a first isolator 3 which is pivotally mounted about a pivot 63 and includes a feeler spindle finger 53 for measuring the duration of the current month on the perpetual twelve cam 9.

The first isolator 3 also carries, directly or indirectly, a pin 6. Preferably, as illustrated in the Figures, the first isolator 3 also carries a lever 5, hinged to one arm 43 thereof on a pivot 73. This lever 5 is loose mounted and pivots, substantially tangentially to second cam 29, and, at a distance from pivot 37, carries said pin 6, which is arranged to cooperate with the second cam 29 on the side of pivot axis D of wheel 31 and, on the opposite side to axis D, with a first arm 77 of a second isolator 7.

This second isolator 7 is pivotally mounted on a pivot 57 comprised in a plate or bridge of the movement 200 or of timepiece 1000 or mechanism 100.

This second isolator 7 includes a second arm 67 arranged, according to the position thereof, to allow, limit or prevent the cooperation of beak 51 of click finger 1 with wheel 31.

According to the invention, mechanism 100 further includes a first isolator 3, pivotally mounted on a pivot 63 relative to the plate or to a bridge of movement 200 or of timepiece 1000.

This first isolator 3, which is substantially Y-shaped here, includes several arms, one of which carries a feeler spindle finger 53 for gathering month information on the periphery of perpetual twelve cam 9, which enables it to take a determined angular position. The first isolator is subjected to the action of a spring 13, which imparts a torque tending to permanently press feeler spindle 53 onto cam 9.

A main arm 83 is arranged in proximity to click finger 1 and wheel 31, between pivot axis D of wheel 31 and perpetual lever 2, and, due to the reading taken by feeler spindle 53, this main arm is positioned at a certain angle relative to click finger 1 and wheel 31.

An external arm 43 is connected to this main arm 83, also located between pivot axis D of wheel 31 and perpetual lever 2 and carries, at an opposite end to main arm 83, a pivot 73 for hinging a lever 5. This lever 5 carries a pin 6 at an opposite end to said pivot 73.

This pin 6 is arranged to limit the angular pivoting travel of lever 5 relative to main arm 83, with which it can cooperate in abutment on a lateral surface 93, which only allows lever 5 limited mobility towards pivot axis D of wheel 31.

Pin 6 of lever 5 is also arranged to limit the angular pivoting travel of lever 5 relative to a second isolator 7, with which said pin 6 can cooperate in abutment on a first arm 77 of said second isolator 7.

This pin 6 is also located on the trajectory of the second cam 29.

According to the invention, this second isolator 7 is loose mounted to pivot on a pivot 57 relative to the plate or to a bridge of movement 200 or of timepiece 1000. This pivot 57 is inserted between the pivot axis of cam 9, the pivot axis D of wheel 31 and the perpetual lever 2.

This second isolator 7 includes a first arm 77 turned towards pivot 73 between the first isolator 3 and lever 5. This first arm 77 may come into abutment, on a bearing surface 47, on pin 6 carried by lever 5, to limit the travel of the second isolator 7.

A spring 37 returns this first arm 77 and therefore lever 5, via pin 6, towards pivot axis D.

The main arm 83 of first isolator 3, adjacent to the external arm 43, is arranged to form a travel limit for pin 6 on the same side as first arm 77 of second isolator 7, said pin 6 being arranged to cooperate in abutment with said first arm 77.

This second isolator 7, which is V-shaped here, includes a second arm 67 directed towards the perpetual lever 2. This second arm 67 includes an external bearing surface 97 on the opposite side to pivot axis D, which is arranged to form a bearing surface for pin 61.

This second arm 67 includes a cut-out 87 arranged, in certain relative positions of second isolator 7 and click finger 1, to allow pin 61 to escape from click finger 1 to uncouple beak 51 from wheel 31.

This second arm 67 includes a lateral bearing surface 97, called the external surface, turned on the opposite side to first arm 77, and on which pin 61 of click finger 1 can abut in certain relative positions between click finger 1 and second isolator 7, whereas in other relative positions between click finger 1 and second isolator 7, said pin 61 can pass underneath the second arm 67 in said cut-out 87.

Depending upon the information gathered by feeler spindle finger 53 on perpetual twelve cam 9, the main arm 83 can occupy four different positions, according to whether the current month has 28, 29, 30 or 31 days. In the particular embodiment illustrated in the Figures, the positions occupied by main arm 83 between pivot axis D of wheel 31 and pivot 57 of the second isolator 7, are substantially parallel to each other, and marked only by the values 28, 29, 30 and 31 corresponding to the number of days in the current month.

For a month of a particular duration, the main arm 83 occupies the position corresponding to said duration.

Lever 5 is loose mounted to pivot at the end of external arm 43 and its position is limited, on the side of pivot axis D of the 31 wheel, by the periphery of the second cam 29, which forms a stop member for pin 6 comprised in lever 5, at the end thereof opposite pivot 73 with the first isolator 3.

This pin 6 itself forms a clearance limit for the first arm 77 of second isolator 7, which is returned by a spring towards pivot axis D of the 31 wheel.

The second isolator 7 is then immobilised in a position in which it forms a barrier for the passage of click finger 1.

Indeed, the second arm 67 thereof tends to resist the passage of pin 61 carried by said click finger 1 via the external bearing surface 97 thereof or via an opposite bearing surface, called the internal surface 37, depending on the relative positions of click finger 1 and second isolator 7. The position of this second arm 67 determines the possible range of interference between beak 51 of click finger 1 and wheel 31. This range of interference defines exactly the number of teeth of the 31 wheel which beak 51 can hook when click finger 1 slides along second isolator 7, during the pivoting movement of perpetual lever 2.

The free passage of pin 61 of click finger 1 along the external bearing surface 97 is possible for the first twenty-seven days of the month, since lever 5 and arm 77 are closest to pivot axis D of the 31 wheel, and the second arm 67 does not prevent click finger 1 from approaching close enough to the thirty-one wheel to shift said wheel by one tooth by the effect of the movement of the perpetual lever 2. For the first twenty-seven days of the month, beak 51 can only hook one tooth of wheel 31 at a time.

During the last days of the month, the movement of pin 61 through second arm 67 is only possible in certain configurations, when pin 61 is opposite cut-out 87 comprised in second arm 67 and turned towards said pin 6. This additional travel offered to beak 51 enables it to hook several teeth of wheel 31 depending on the day of the month, and the position of the first isolator 3 determined by month cam 9.

Indeed, the position of the main arm 83 of first isolator 3 determines the position of pin 6 of lever 5 and consequently determines an angular stop position of the second isolator 7, and the clearance of the window allowed for the passage of pin 61 of lever finger 1 in cut-out 87 of second arm 67 of second isolator 7. This clearance allows beak 51 of click finger 1 to hook one tooth for a month of 31 days, two teeth for a month of 30 days, three teeth for a month of 29 days and four teeth for a month of 28 days.

According to the invention, mechanism 100 further includes a control lever 12, pivotally mounted on a pivot 612 relative to the plate or to a bridge of movement 200 or timepiece 1000, or mechanism 100. This control lever 12 includes a feeler spindle 512 arranged to follow the first cam 4, which pivots control lever 12 to drive the date display means 412 by a drive element 612.

This control lever 12 further includes a hook 8, which is pivotally mounted on a click pivot 712 and arranged to ensure the driving of the perpetual twelve cam 9 at the end of each month.

This control lever 12, which is substantially S-shaped here, carries, in the median part thereof, on the one hand feeler spindle 512, arranged to follow the profile of the first thirty-one cam 4 by the action of a spring 312, and on the other hand, hook 8, pivoting on a pivot 712.

Depending on the angular position achieved by the thirty-one wheel, and thus depending on the angular position of first cam 4 which is integral therewith, the position of radial extension of feeler spindle 512 represents the date, and in particular the new date, as soon as click finger 1, actuated by perpetual lever 2, has finished pivoting the thirty-one wheel by driving one or more teeth of said wheel, before returning to the rest position, returned by the return of perpetual lever 2 to its own rest position, by the action of the return spring of said lever.

Control lever 12 further includes, for the instantaneous date display, a toothed sector 912, which is opposite pivot 612 here and cooperates with a pinion 412 for the direct or indirect display of the date, for example via a hand or similar.

The pivoting movement of wheel 31, and thus of first cam 4, indirectly drives hook 8, which is arranged to cooperate with the ratchet 69 with twelve teeth, and to pull said ratchet to correct the month display, when first cam 4 jumps from its largest to its smallest diameter, which pivots ratchet 69 by one step.

The perpetual lever 2 also actuates, via a beak 42 or similar, the pivoting of a day of the week star wheel 420, retained by a click 421 or by a jumper spring. This star wheel 420 carries or drives a name of the day of the week display.

Figure 3:
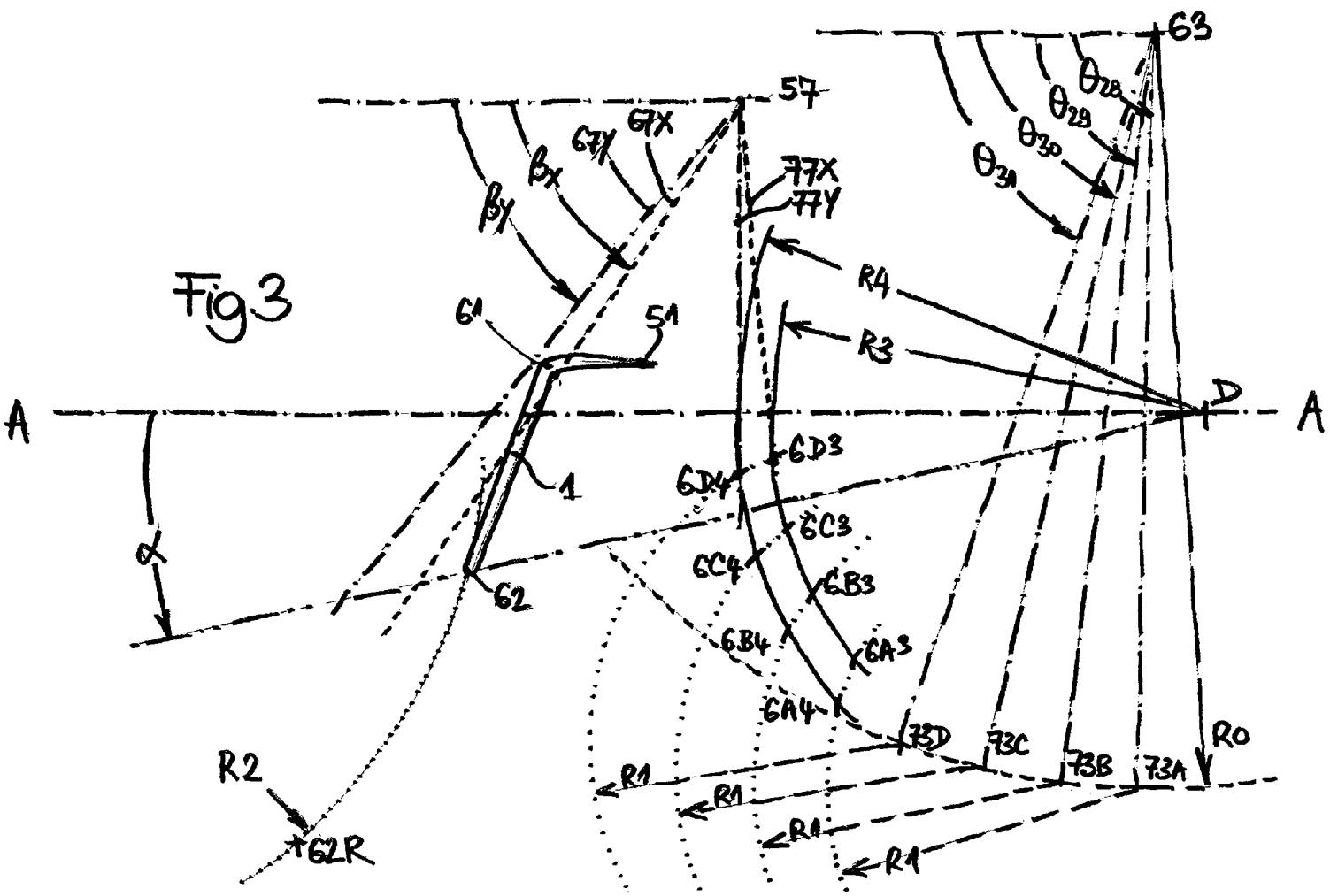
FIG. 3 shows a schematic plan view of the geometrical arrangement of the pivot axes and angular clearances of the main components of the countdown mechanism.
Figure 4:
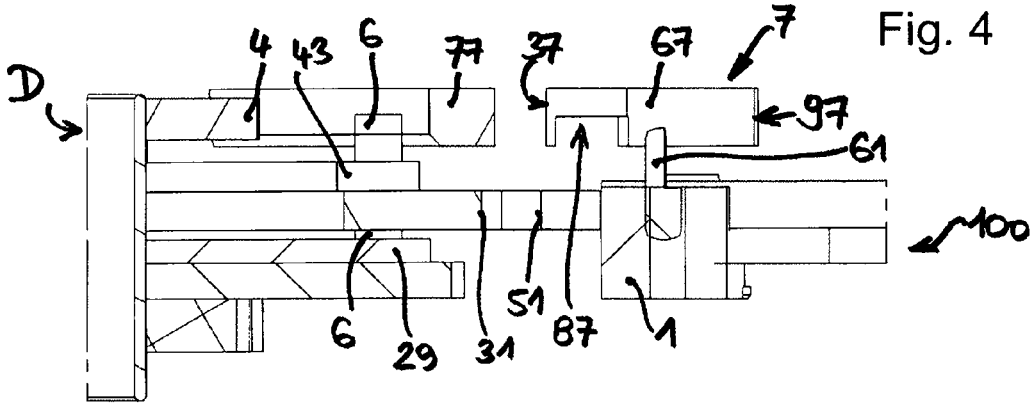
FIG. 4 shows a partial schematic view of a wheel set, seen in a cross-section passing through the pivot axis thereof, comprised in said countdown mechanism and the cooperation thereof with first and second isolators and a finger which is also comprised in said countdown mechanism and which is hinged to the perpetual lever of FIG. 1.
Figure 5:
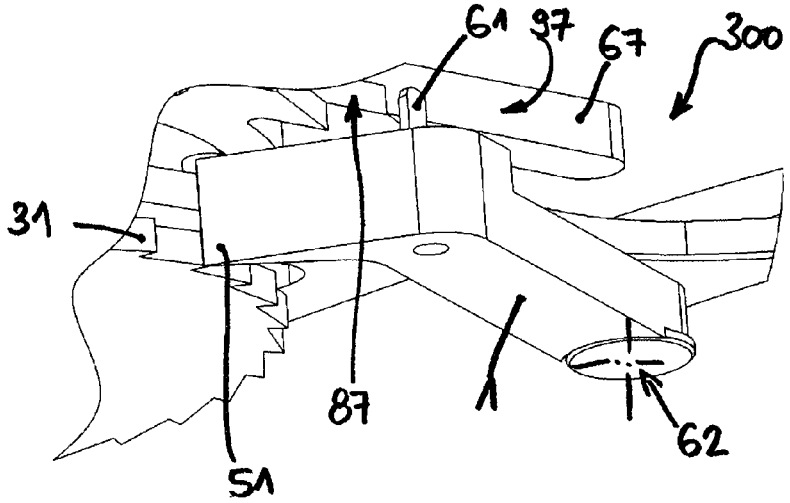
FIG. 5 shows a partial, schematic, perspective view a detail of the cooperation between said finger, said second isolator and a thirty-one wheel comprised in said wheel set.
Figure 8:
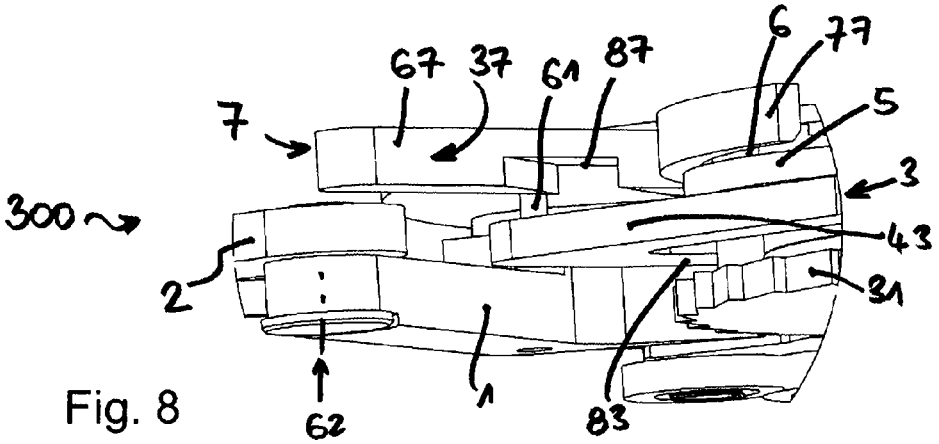
FIG. 8 shows a partial, schematic, perspective view of a detail of the cooperation between the finger and the second isolator, in proximity to a cut-out comprised therein.
Figure 6:
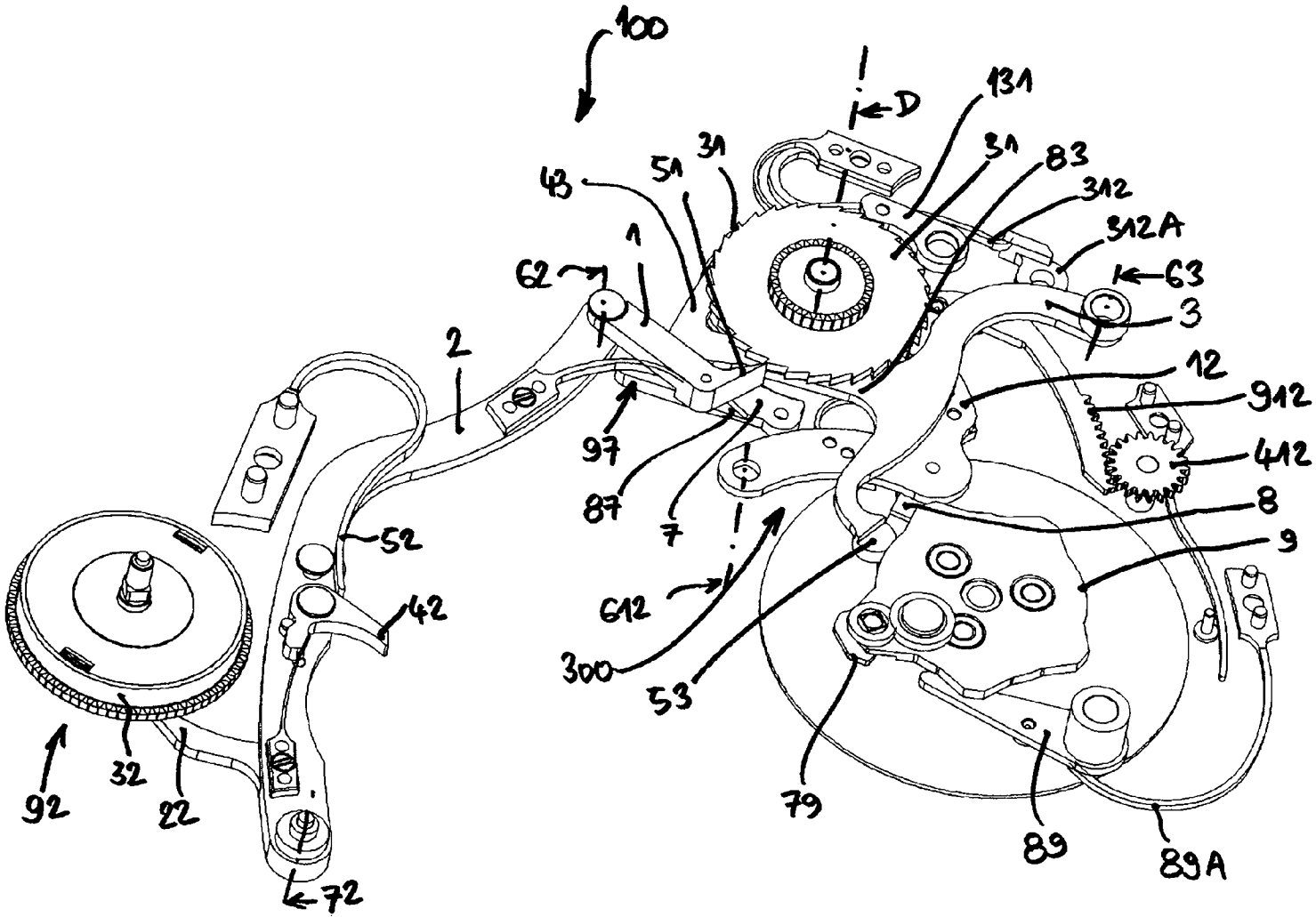
FIG. 6 shows a partial, schematic, perspective, bottom view of the date mechanism according to the invention.
Figure 7:
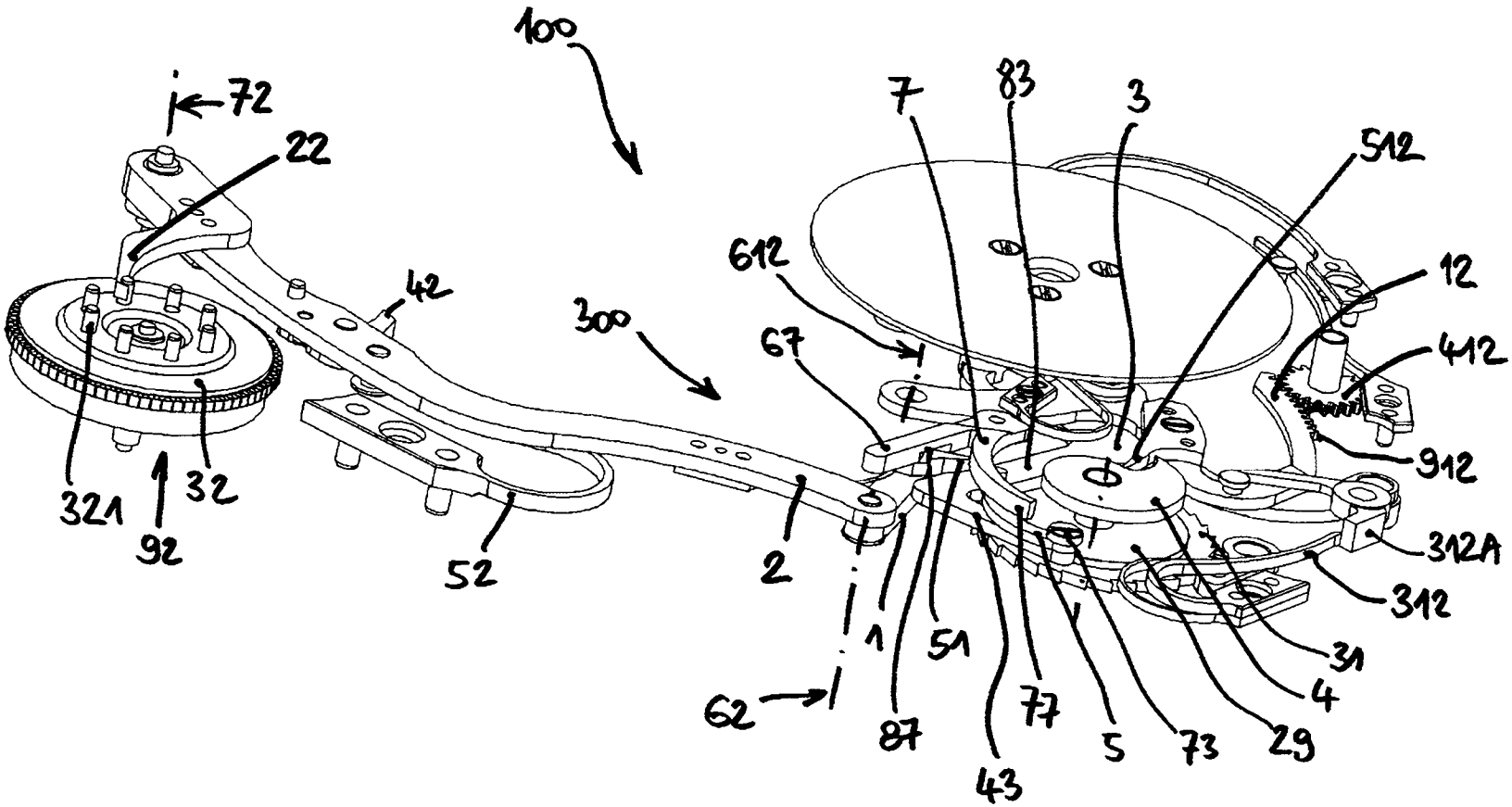
FIG. 7 shows a partial, schematic, perspective, top view of the date mechanism according to the invention.
Figure 9:
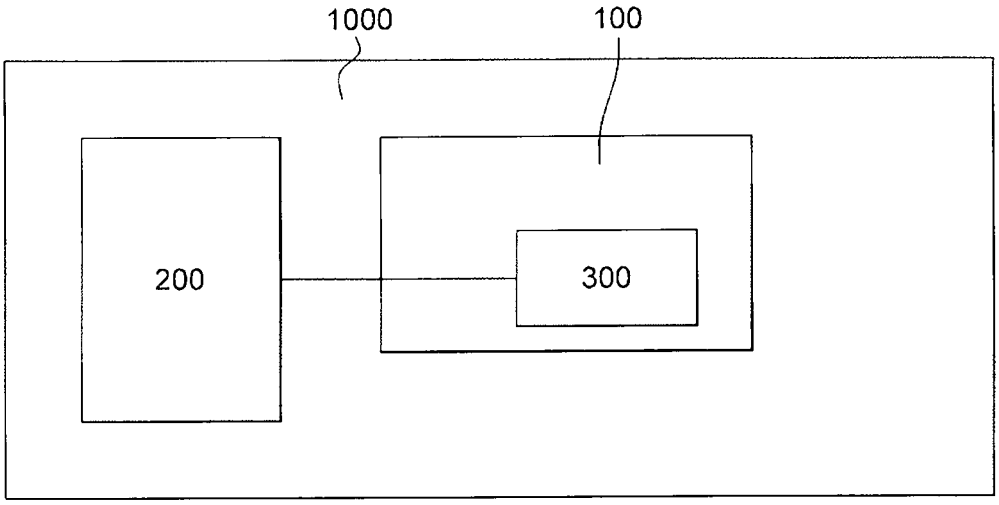
FIG. 9 shows, in the form of a simplified block diagram, a timepiece and the date mechanism thereof.

In the rest position of perpetual lever 2, and of click finger 1, beak 51 thereof is located, relative to a straight line derived from pivot axis D of the thirty-one wheel passing through the instantaneous position of pivot 62 of click finger 1, at the end of perpetual lever 2, on the same side as pivot 57 of second isolator 7, as seen in FIG. 3. This straight line forms an angle $\alpha$ relative to a reference direction AA.

At this stage, pin 61 of click finger 1 is located in proximity to the second arm 67 of second isolator 7 and is in proximity to the bearing surface of this second arm 67 of second isolator 7, without touching the isolator when perpetual lever 2, and thus feeler spindle finger 1, is in the rest position. This second arm forms an angle $\beta$ with reference direction AA.

The first arm 77 of the second isolator is returned towards pivot axis D of the thirty-one wheel by a spring 37. The action of second cam 29 on lever 5 tends to pivot said lever, on the last day of the current month, relative to pivot 73 of first isolator 3.

The angular position of this first isolator 3 is fixed, in the middle of a given month, since this first isolator 3 takes its position via feeler spindle 53 on month cam 9. Throughout the year, the position of this pivot 73 thus moves, as seen in FIG. 3, over a circle centred on pivot 63 and of constant radius R0, by taking angular positions $\theta$28, $\theta$29, $\theta$30, $\theta$31, according to the current month and the reading taken by feeler spindle 53, corresponding to the pivot positions 73A, 73B, 73C, 73D seen in FIG. 3.

The position of pin 6 of lever 5 is located on a circle centred on pivot 73 and of radius R1 corresponding to the constant distance of centres from pivot 73.

Pin 6 abuts on the periphery of the second cam 29, whose radial position moves between a small radius R3 and a large radius R4.

Thus, depending on the position of second cam 29, the position of pin 6 varies between positions 6A3 and 6A4 in a month of 28 days, between the positions 6B3 and 6B4 for a month of 29 days, between positions 6C3 and 6C4 for a month of 30 days, and between positions 6D3 and 6D4 for a month of 31 days.

The abutment of first arm 77 of second isolator 7 on pin 6 is thus dependent on this position of pin 6, and the angle $\beta$ made by the second arm 67 with direction AA also, as seen in FIG. 3, which shows two positions X and Y of second isolator 7, the position 67X ad 77X in broken lines and the position 67Y and 77Y in dot and dash lines.

FIG. 3 also shows the variation in position of pivot 62 for hinging click finger 1 on perpetual lever 2, on a radius R2 relative to pivot axis 72 thereof, between a rest position 62R and a current position 62.

FIG. 3 shows that, the longer the current month is, the smaller the corresponding angle θ will be, and the smaller the corresponding angle β will be.

During the month, up until the day before the last day of the month, the second isolator 7 remains pressed in proximity to the first radius R3 of cam 29.

When click finger 1 is wound by the pivoting of perpetual lever 2, in the direction in which pivot 62 moves away from pivot axis D, pin 61 is on the side of external bearing surface 97, on the opposite side to centre of pivoting D, of second arm 67 of second isolator 7 and pin 61 moves away from pivot 57 during winding. While second isolator 7 remains pressed onto the first radius R3 of cam 29, the cut-out 87 of second arm 67 does not move. Consequently, when perpetual lever 2 returns, pin 61 is still guided by external bearing surface 97 and slides over said surface, and beak 51 can only hook the number of teeth that it can reach. By design, this number of teeth is only one tooth.

However, on the last day of the month, the second isolator 7 pivots, since finger 29A of cam 29 pushes lever 5 and pin 6 back outwards, and thus also pushes back the first arm 77 of second isolator 7, which takes its most off-centre position relative to pivot axis D, i.e. depending on the month, pin 6 moves to occupy one of positions 6A4, 6B4, 6C4, 6D4 of FIG. 3, which shows the positions of second isolator 7 during the change from 6D3 to 6D4, and the angle of the second arm 67 with direction AA then changing from the value βX to the value βY which is lower. This second arm is then raised. There is thus only day each month above finger 29A, enough time to pass into cut-out 87 with pin 61, and thus to start the change of month.

Due to the different angle of the second arm 67, pin 61 no longer runs alongside the arm, but passes through cut-out 87 before beak 51 leaves one of the teeth of wheel 31. Thus, beak 51 abuts on the main arm 83 of the first isolator once perpetual lever 2 has finished winding. Pin 61 then passes to the other side of second arm 67 to find its position. Depending upon how far away pivot 73 is, caused by the movement of the first isolator 3 according to the current month, the number of teeth to be hooked by beak 51 thus varies and may be two, three or four.

After the teeth have been driven, and the joint pivoting of wheel 31 and cam 4, feeler spindle 512 drops onto the snail of cam 4, from the largest to the smallest diameter, starting a retrograde movement, a return of rack 912, and the date mechanism then displays, on pinion 412, the first day of a new month, while hook 8 drives the perpetual twelve cam 9 to display the new month, and thus to modify the angular position of first isolator 3 in accordance with the new reading taken by feeler spindle 53.

FIGS. 10 to 27 illustrate the operation of the countdown mechanism 300 on particular dates, displaying the respective positions of click finger 1 of the second isolator and cams 4 and 29.

Figure 10:
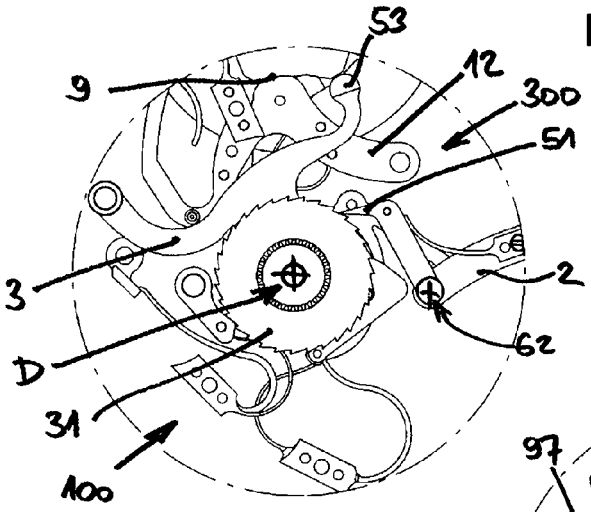
Figure 11:
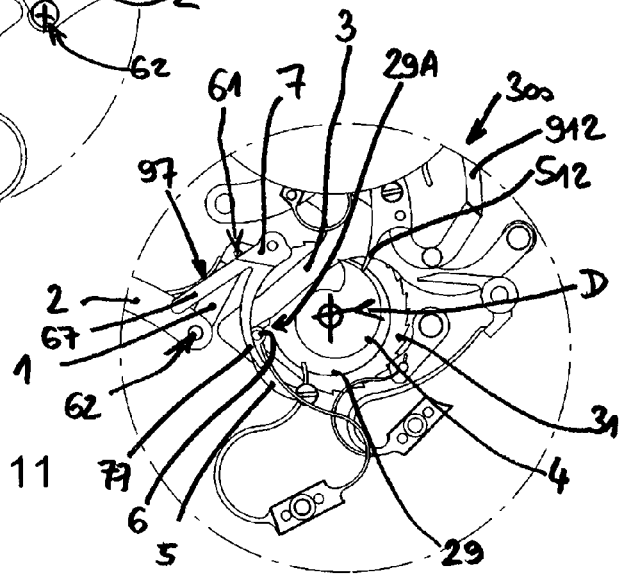
Figure 12:
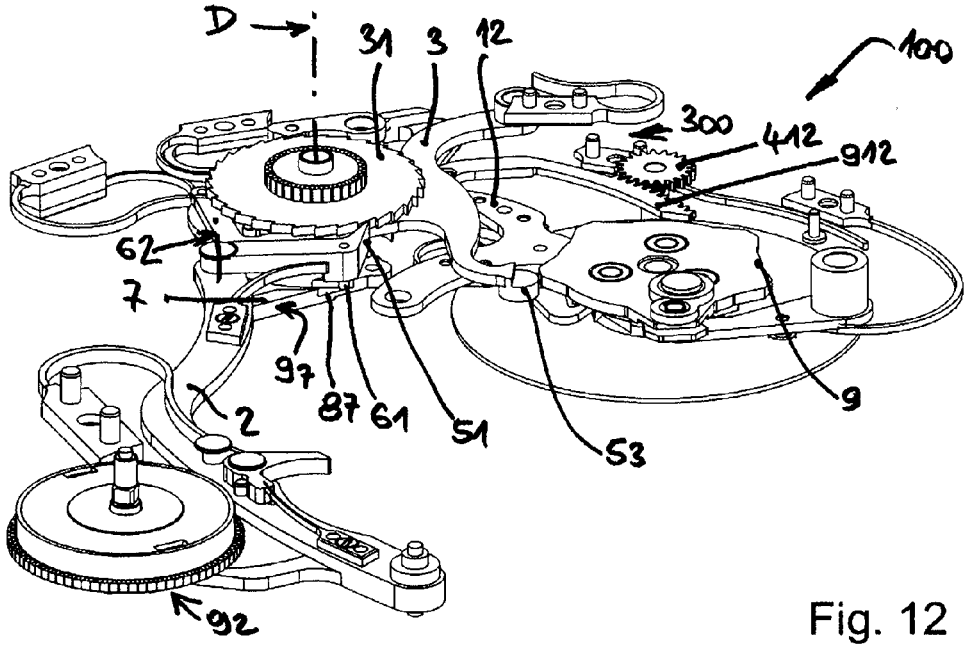

FIGS. 10, 11, 12 show mechanism 300 in the rest position on 30th November. Feeler spindle 53 is on the 30 day month level of cam 9. Pivot 73 is then in position 73C of FIG. 3. Feeler spindle 512 is close to the maximum radius of cam 4. The 30th November is the last day of the month of November, thus finger 29A of cam 29 pushes back lever 5, its pin 6, which changes from position 6C3 to position 6C4 of FIG. 3 and thus the first arm 77 of second isolator 7, which is thus pivoted by angle βY of FIG. 3. FIG. 12 shows finger 61 still in proximity to bearing surface 97 and in proximity to cut-out 87.

Figure 13:
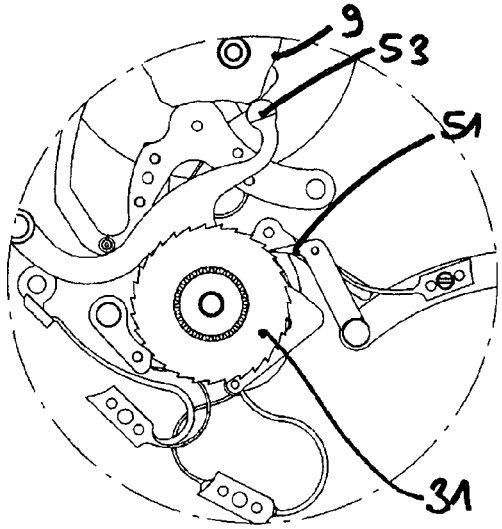
Figure 14:
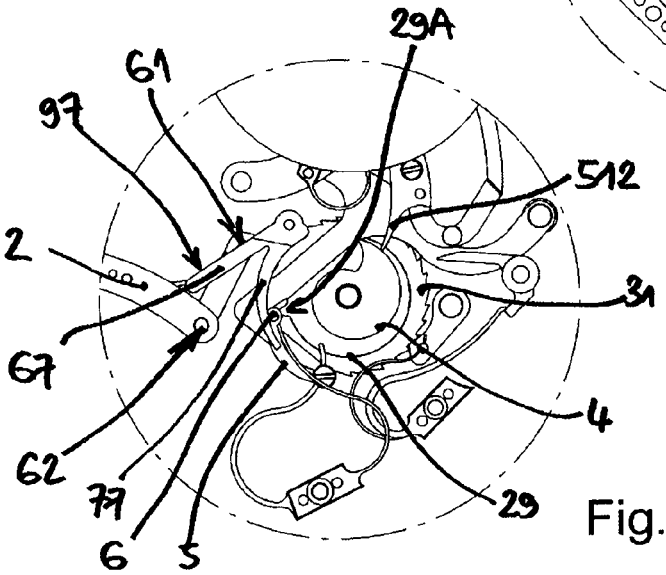
Figure 15:
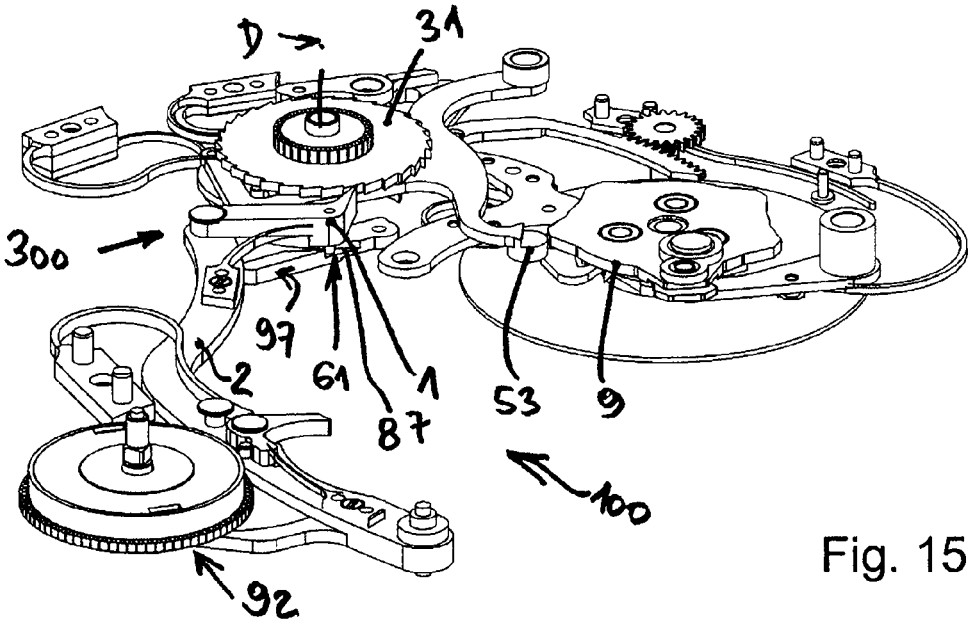

FIGS. 13, 14, 15 show mechanism 300 in action, prior to the passage of finger 61 into cut-out 87 of second isolator 7, on the same date, 30th November. Finger 61 is shown engaged in cut-out 87.

FIGS. 16, 17, 18 illustrate the passage of finger 61 into cut-out 87 on the same date, 30th November.

During the date change from 30th November to 1st December, feeler spindle 512 falls from the largest to the smallest radius of cam 4, control lever 12 makes its retrograde movement, and hook 8 which the control lever carries pulls ratchet 69 to display the new month, both on cam 9 for controlling mechanism 300 and for the month display if timepiece 1000 is provided with such display means, which only has to be coupled to the pivot axis of said wheel 69. Toothed sector 912 returns date display pinion 412 to the first of the month.

Figure 19:
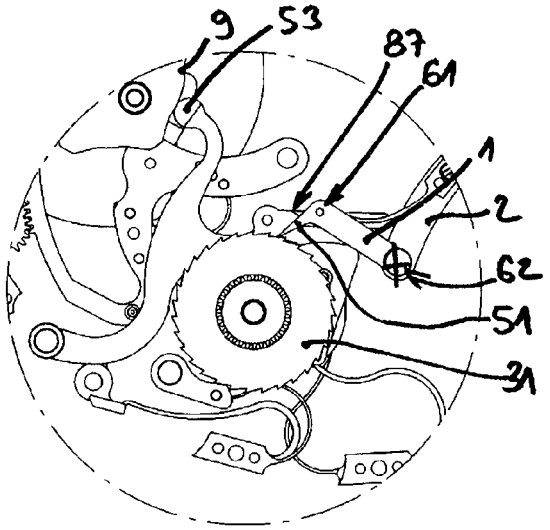
Figure 20:
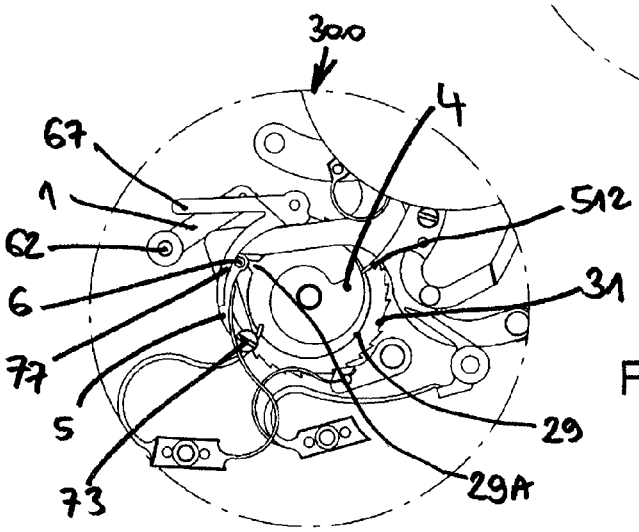
Figure 21:
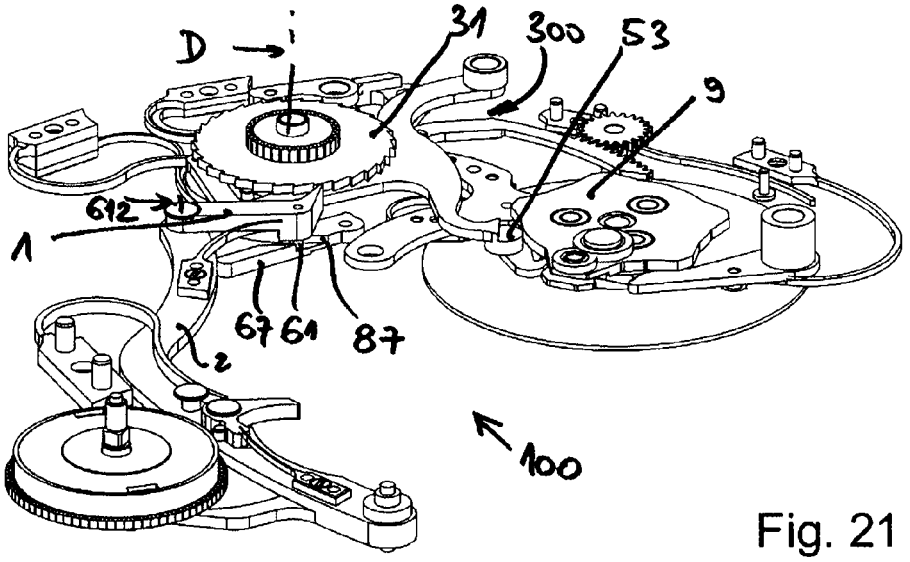

FIGS. 19, 20, 21 show mechanism 300 in action, when finger 61 passes into cut-out 87 on the 31st December. FIG. 19 shows that feeler spindle 53 is abutting on a sector of smaller radius of cam 9, corresponding to a month of 31 days. During the date change, cam 9 will pivot to the next sector, which also corresponds to a month of 31 days, which is January.

Figure 25:
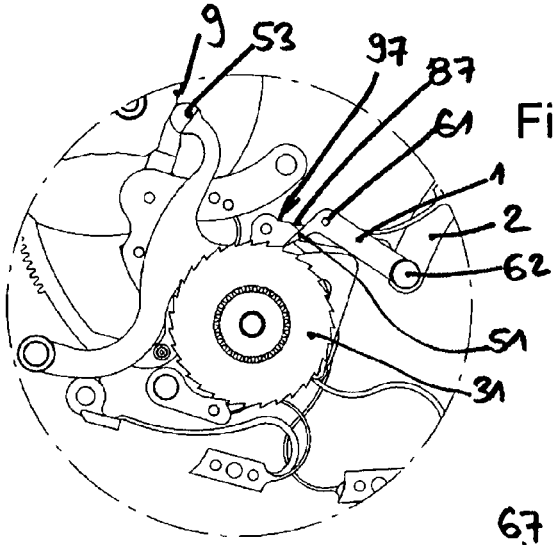
Figure 26:
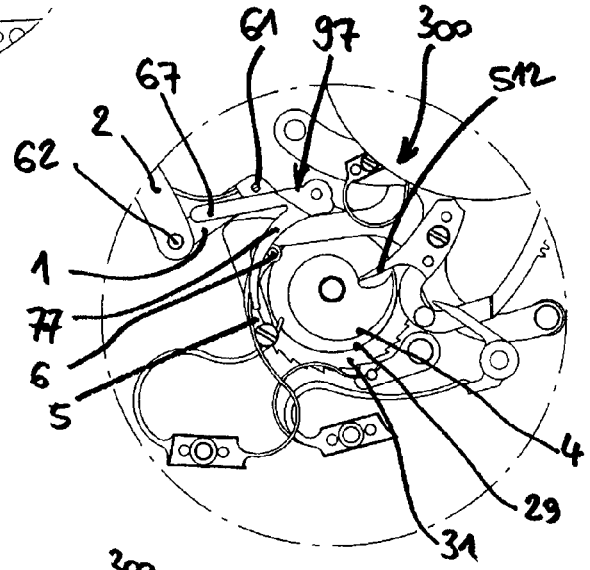
Figure 27:
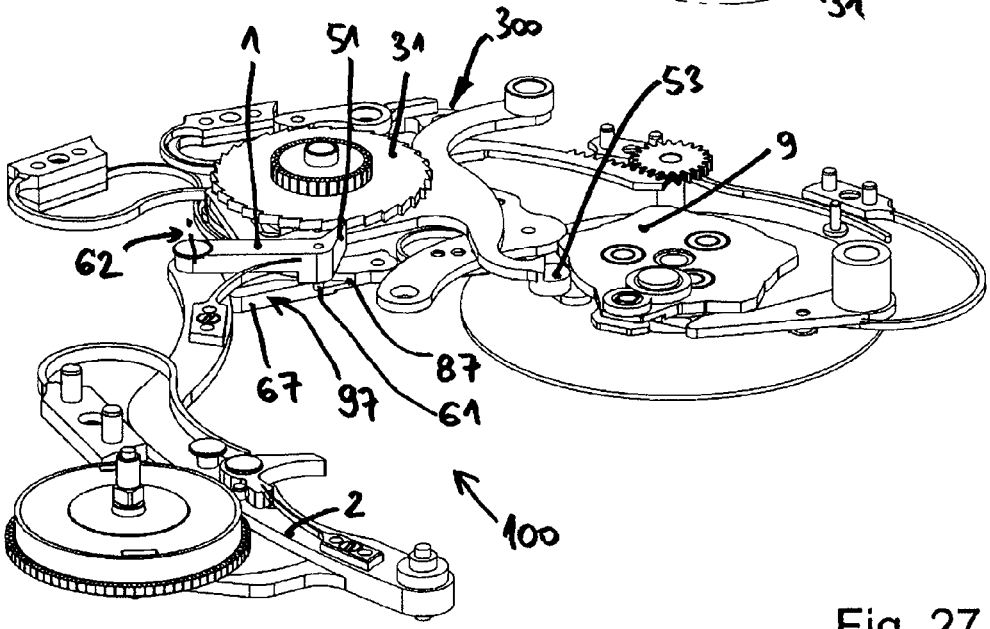

FIGS. 22, 23, 24 show the mechanism in action, at maximum winding, on 1st December, which is an ordinary day, where finger 61 cannot pass through cut-out 87 and can only slide over bearing surface 97 during the movement of perpetual lever 2, and hook the single tooth of an ordinary day change, as seen in FIGS. 25, 26, 27 which show this change of date from 1st to 2nd December, during which finger 61 cannot pass through cut-out 87 and slides over surface 97.

The invention also concerns a timepiece 1000 including a movement 200 and/or a date mechanism 100 of this type. According to the invention, movement 200 is arranged to actuate, once per day, a pivoting movement of a perpetual lever 2 comprised in this date mechanism 100.

The invention provides the advantage of gathering information via a single click, to determine the number of days to be jumped. The mechanism works when the lever falls, and thus has the advantage of instantaneous operation. The torque used is more constant than in the multi-click systems of the prior art, and the mechanism according to the invention behaves in the same manner between the days at the start of a month with a single jump and the days at the end of a month with several jumps.

What is claimed is:

1. A date mechanism for a timepiece, which includes a movement arranged to actuate, once per day, the pivoting movement of a perpetual lever comprised in said date mechanism, said mechanism comprising a means of driving a perpetual twelve cam, which includes twelve sectors for the successive months, of different radial dimensions according to the duration of each month, and which completes one revolution per year, wherein said mechanism has only a single click and includes a single click finger, hinged to said perpetual lever and arranged to cooperate directly with a toothing comprised in a thirty-one ratchet wheel which pivots integrally about a pivot axis of a first thirty-one snail cam directly or indirectly controlling a date display means, and a second cam determining the position of a countdown mechanism arranged to adjust the duration of cooperation between said click finger and said wheel according to the current month and the current day of the month and to determine each day the number of teeth of said wheel to be actuated, and said countdown mechanism measuring the duration of the current month on said perpetual twelve cam and according to the position of a pin comprised therein, allowing, limiting or preventing cooperation between a beak of said click finger and said thirty-one ratchet wheel.

2. The date mechanism according to claim 1, wherein said second cam includes a radial thirty-one finger, and wherein said countdown mechanism includes a first isolator with a feeler spindle finger for measuring the duration of the current month on said perpetual twelve cam, and carrying said pin arranged to cooperate with said second cam on the side of said pivot axis of said thirty-one ratchet wheel, and on the opposite side to said axis, with a first arm of a second pivoting isolator which includes a second arm arranged, according to the position thereof, to allow, limit or prevent the cooperation of said beak of said click finger with said thirty-one ratchet wheel.

3. The date mechanism according to claim 2, wherein said click finger is bent between, on the one hand, a pivot on which said finger is hinged on said perpetual lever and, on the other hand, said beak, and wherein said click finger includes, located substantially in said bend, a projecting pin, and wherein said second arm of said second isolator includes a cut-out arranged, in certain relative positions of said second isolator and of said click finger, to allow said pin to escape from said click finger to uncouple said beak from said wheel.

4. The date mechanism according to claim 3, wherein said second arm of said second isolator includes an external bearing surface on the opposite side to said pivot axis, arranged to form a bearing surface for said pin.

5. The date mechanism according to claim 2, wherein said first isolator is pivotally mounted about a pivot and includes said feeler spindle finger, and that said first isolator further carries, hinged to one arm thereof on a pivot, a loose mounted lever pivoting substantially tangentially to said second cam and which includes, at a distance from said pivot, said pin, and further wherein said second isolator is pivotally mounted on a pivot comprised in a plate or a bridge of said movement or said timepiece or said mechanism and wherein, on the last day of the month, said second isolator pivots, said thirty-one finger of said cam tending to push said lever and said pin back outwards and also to push back said first arm of said second isolator.

6. The date mechanism according to claim 2, wherein said first arm of said second isolator is arranged to form a stop member for said pin.

7. The date mechanism according to claim 1, wherein said date mechanism includes a control lever pivotally mounted on a pivot comprised in a plate or a bridge of said movement or of said timepiece or said mechanism, said control lever including a feeler spindle arranged to follow said first cam, which pivots said control lever to drive said date display means via a drive element, and said control lever further includes a hook which is pivotally mounted on a click pivot and arranged to ensure the driving of said perpetual twelve cam at the end of each month.

8. The date mechanism according to claim 1, wherein the mechanism is an instantaneous date mechanism arranged to pivot said perpetual lever instantaneously via an abrupt daily action, at midnight.

9. The date mechanism according to claim 8, wherein said instantaneous mechanism includes a barrel which carries a plurality of pins, each arranged to interact with a feeler spindle finger comprised in said perpetual lever, to pivot said lever instantaneously.

10. The date mechanism according to claim 1, wherein said mechanism includes a mechanism for adjusting the duration of the month of February for normal or leap years and/or common end of century years.

11. The timepiece comprising a movement, and including a date mechanism according to claim 1, wherein said movement is arranged to actuate, once per day, a pivoting movement of a perpetual lever comprised in said date mechanism.

* * * * *